US005380007A

United States Patent [19]

Travis et al.

[11] Patent Number: 5,380,007

[45] Date of Patent: Jan. 10, 1995

[54] VIDEO LOTTERY GAMING DEVICE

[76] Inventors: Christopher P. Travis, 7603 141 St.; Richard C. Travis, 7635 141 St., both of, Seminole, Fla. 34646

[21] Appl. No.: 185,426

[22] Filed: Jan. 21, 1994

[51] Int. Cl.[6] ..... A63F 5/00

[52] U.S. Cl. ..... 273/138 A; 273/149 B; 273/144 A; 273/269; 273/434

[58] Field of Search ..... 273/138 A, 144 B, 144 R, 273/144 A, 433, 434

[56] References Cited

U.S. PATENT DOCUMENTS

| | | | |
|---|---|---|---|
| 4,871,171 | 10/1989 | Rivero | 273/138 A |
| 4,961,578 | 10/1990 | Chateau | 273/144 R |
| 5,088,737 | 2/1992 | Frank et al. | 273/138 A |
| 5,121,920 | 6/1992 | Laezzo et al. | 273/144 B |

OTHER PUBLICATIONS

Garron Plastics Corp.-Lottery drawing machines Jul. 2, 1991.

*Primary Examiner*—Theatrice Brown

*Assistant Examiner*—Kerry Owens

*Attorney, Agent, or Firm*—Joseph C. Mason, Jr.; Ronald E. Smith

[57] ABSTRACT

A video game apparatus includes simulated cylindrical housings that are filled with simulated numbered balls that are apparently mixed by a simulated upflowing stream of air through the cylinders. After the passage of a predetermined amount of time, the mixing stops and a simulated ball having a simulated number appears in a simulated ball trapping member above each cylinder to create the impression that the trapped simulated balls escaped their associated cylinders by riding the simulated upflowing airstream. Mechanical buttons are pressed by a player to select a player's random number, and a random number generator in the game apparatus picks a random number and determines the respective numbers of the balls trapped in the simulated ball trapping members. A monetary award is mechanically dispensed by the apparatus if the random number selected by the player matches the random number generated by the random number generator.

10 Claims, 8 Drawing Sheets

VIDEO LOTTERY GAMING DEVICE

BACKGROUND OF THE INVENTION

1. Field of the invention

This invention relates, generally, to lottery games. More particularly, it relates to an electronic gaming device that simulates a mechanical lottery gaming device.

2. Description of the prior art

Many state-sponsored lottery games employ a mechanical device that selects numbers randomly by mixing numbered balls in an upwardly flowing airstream in a cylindrical chamber and selecting, as the winning numbers, the numbers on the balls that escape the chamber. Typically, the balls are ping pong balls, and they are selected when they become lodged in a narrow neck at the top of the chamber when they try to escape the chamber by riding the upwardly flowing airstream.

The airstream does a good job of mechanically mixing the balls, and the sounds of the balls mixing and finally popping into the narrow neck as they try to escape from the chamber are pleasant sounds which draw the attention of the viewer. Most importantly, everyone playing the particular lottery game that uses the air-mixed balls is satisfied that the results of the game are truly random in nature.

The machines are generally used by state governments and the games played with the machines are usually televised. Thus, few people actually use such machines. Gambling establishments rarely use such machines because they are too noisy for the typical establishment, too mechanically complicated, and thus too expensive to purchase and maintain.

Thus, there is a need for a quieter, less mechanically complicated, and less expensive version of the machine. However, when the art was considered as a whole at the time the present invention was made, it was not obvious to those of ordinary skill in the art that the provision of such a device was desirable and therefore it could not have been obvious as to how such a desirable objective could be achieved.

SUMMARY OF THE INVENTION

The insight behind the present invention is the realization that the mechanical mixing of the balls in an airstream in a cylindrical transparent chamber and their successive selections in a narrow neck could be simulated by a computer means and displayed on a video screen. Thus, the need for an expensive machine having a noisy air compressor is obviated, as is the need to maintain such a machine.

The novel device includes novel software that generates and displays on a video screen a plurality of chambers or housings having a transparent, cylindrical appearance. Each of the chambers appears to have table tennis balls therein, and the balls appear to be numbered. When the device is activated, the software generates audible sounds of compressed air blowing into each of the cylinders, balls mixing and bouncing off one another and off the inner sidewalls of the chambers, and the sucking sound of the balls popping into narrow necks as they apparently attempt to escape from the respective chambers. A video display of the balls tumbling within their respective housings and escaping therefrom into the narrow necks at the top of each housing is timed to match the audio sounds so that the viewer is treated to a video version of the well-known mechanical machine.

Mechanical buttons are provided so that a player may mechanically select the numbers he or she desires to play in an attempt to win a jackpot. Mechanical coin or bill-accepting devices are also provided. A game is started by depositing a coin; the player then punches in the number of his or her choice, and pushes a "Start" button. The numbers selected by the player are electronically displayed at a convenient location on the device. Pushing the "Start" button starts the sound and video effects, and disables the player's ability to change the player's selected random numbers. After a preselected amount of time has elapsed, an apparent (computer-generated) ball in a first apparent chamber appears to be selected by popping into an apparent neck at the top of its chamber, and the other apparent balls in the other apparent cylinders follow suit thereafter in sequence, just as in the mechanical version of the game. As the apparent balls are apparently selected, the player reads the numbers on the selected balls to determine whether or not they match the player-selected numbers. If they do, a jackpot is paid in the conventional manner. The machine also displays the numbers of the selected apparent balls in a display means adjacent the display means containing the player-selected numbers.

It should therefore be understood that the primary object of the present invention is to provide the world's first lottery machine that provides an audio and video simulation of the well-known ping-pong ball blowing machine.

Another object is to provide a machine that combines mechanical and electronic features so that the player has the feel of dealing with a mechanical machine.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
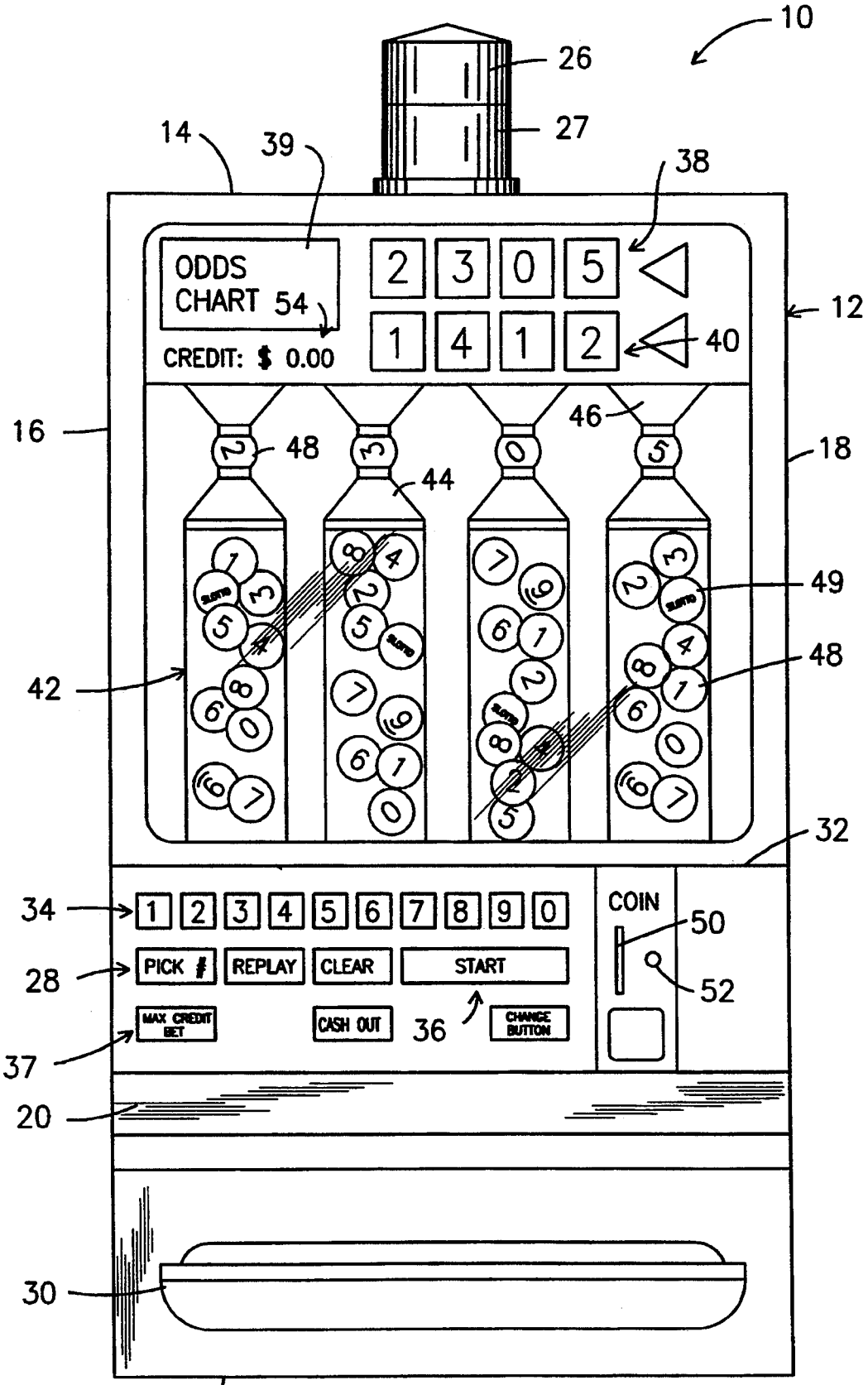
FIG. 1 is a front elevational view of an exemplary embodiment of the novel device.
Figure 2:
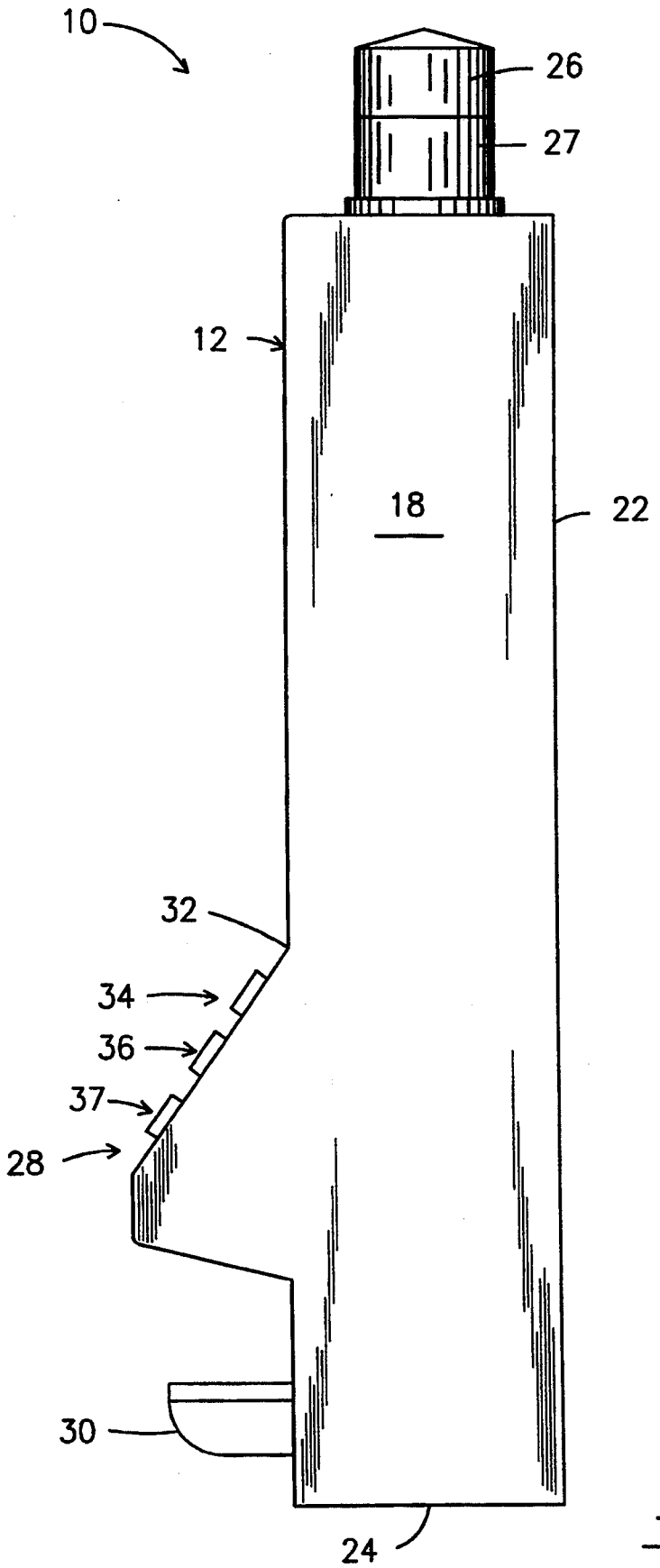
FIG. 2 is a side elevational view thereof.

Referring now to FIGS. 1 and 2, it will there be seen that an illustrative embodiment of the novel apparatus is denoted as a whole by the reference numeral 10. The apparatus includes a hollow main body 12 of parallelepiped construction. More particularly, it has a top wall 14, upstanding side walls 16, 18, front wall 20, rear wall 22, and bottom wall 24. A double light 26, 27 surmounts top wall 14; light 26 may be activated by a player to summon a floorwalker for change, information, or the like. Light 27 flashes when a player has won a game; a siren or other noise-maker may also be activated when a game has been won. Moreover, both lights 26 and 27 may flash when a game has been won.

A keyboard 28 extends outwardly and downwardly relative to front wall 20 as best understood in connection with FIG. 2, and a coin tray 30 into which a player's winnings are deposited is positioned therebelow.

Line 32 indicates the line of demarcation between the electronic parts of the novel apparatus 10 and the mechanical parts. Essentially everything above demarcation line 32 (with the exception of the housing and double light 26, 27) is computer generated, and everything below said line is mechanical to give the player a feel of playing with a mechanical device.

Three rows of mechanical buttons are provided on keyboard 28. The buttons in the first or uppermost row are collectively denoted 34, the buttons in the second row are collectively denoted 36, and the buttons of the third row are collectively denoted 37. Buttons 34 are numbered 0–9 as depicted. Buttons 36 include a "Pick #" button, a "Replay" button, a "Clear" button, and a "Start" button. Buttons 38 includes a "Maximum Credit Bet" button, a "Cash Out" button, and a "Change" button. Pressing the "Change" button activates light 26 to summon a floorwalker so that the player can get change for bills if needed without leaving the machine.

The upper part of the housing includes two display means; the first means 38 displays the winning numbers as generated by a random number generating means within the machine and the second means 40 displays the numbers selected by the player or by the machine if the player instructs the machine to pick a random number in the manner hereinafter set forth. If the two displays match, a payout is made into coin box 30. For large winnings, a redeemable coupon is dispensed into said coin box.

Odds chart 39 displays management information such as the size of the respective payoffs if the player's numbers match one, two, three, or all four of the machine's numbers.

The intermediate part of the housing is a video screen generated by the novel software; it may run in a demonstration mode to attract players at all times the establishment is open for business, or it may remain frozen in the last frame of the previous game if desired. As will become more clear hereinafter, the machine may also remain in an idle mode after each game, accompanied by the sound of upwardly flowing air maintaining the numbered balls that have been captured above their respective cylinders in their respective FIG. 1 positions. Thus, when a new game commences, the sound of the upwardly flowing air is diminished for a moment to apparently allow the apparent (computer-generated) balls to apparently drop back into their respective apparent cylinders for re-mixing, as will be more fully set forth hereinafter.

Said intermediate part of the novel game apparatus includes a plurality of apparent, i.e., simulated transparent cylinders, collectively denoted 42; there are four in number in the preferred embodiment but any number of apparent cylinders are within the scope of this invention. A first simulated or apparent funnel 44 surmounts each apparent cylinder, and a second apparent funnel 46 is spaced thereabove in vertically flipped relation thereto. This arrangement of apparent funnels creates an apparent physical space therebetween within which apparent balls 48 are trapped when the machine operates; in the claims that follow, the simulated funnels are referred to as simulated ball trapping members.

Each cylinder 42 includes a plurality of software-generated balls numbered 0–9 as shown and a single ball 49 having the term "Slotto" apparently imprinted thereon. The "Slotto" ball is a "wild" ball that matches any computer-generated random number. Thus, if a player correctly selects three numbers in the order selected by the machine's random number generator, the appearance of a simulated Slotto ball in a ball trapping member in the fourth apparent cylinder wins the game for the player. As a further example, the appearance of all four Slotto balls in the respective ball trapping members would result in a payoff regardless of the number picked by the player.

The configuration shown in FIG. 1 depicts the end of a game where a player has lost the game; note that the player-selected numbers 40 do not match the software-selected numbers 38 and thus the numbers on apparent balls 48 trapped between the simulated ball trapping members 44, 46.

To play the game, a player deposits a coin in coin slot 50 at the mechanical end of the device; a bill-accepting means and a credit card-accepting means are also within the scope of this invention. A light 52 then comes on to indicate that the apparatus has been activated, and the amount of the player's credit is displayed on screen 54 near the top of the device. For example, the amount of $1.00 will be displayed on screen 54 if a player inserts four quarters in coin slot 50. If each game costs a quarter, the software will deduct that amount from the display screen after each game and display the remaining credit at display 54.

In lieu of depositing coins, the player may press the "Maximum Credit Bet" button in row 37, and the management established maximum credit will appear on screen 54.

After the player has deposited money into the machine, or pressed the "Maximum Credit Bet" button as aforesaid, he or she has the option of selecting his or her own numbers by punching the mechanical buttons in row 34 or of requiring the machine to pick a random number by depressing the "Pick #" button in row 36. If that option is selected, the novel software randomly picks a number and displays it on row 40 at the top of the machine. If the player decides to select the numbers, the selected number is displayed in said row 40. The player then presses the "Start" button, and the software then generates the sound of an air compressor slowing down to allow the balls in the ball trapping members 44, 46, from the previous game, to apparently fall back into their respective cylinders. The sound of the air compressor is then increased to begin the tumbling motion that mixes the balls. The software generates sounds for a predetermined amount of time that mimic the sounds of ping-pong balls bouncing off one another and off the sidewalls of their respective cylinders. The apparent numbers on the balls as they mix remain facing the player so the player can see the balls being mixed by the apparent upwardly flowing airstream which can be heard but not seen, just as in the mechanical version of the game. The software could also be employed to cause the apparent balls to rotate so that the numbers would be concealed from time to time, but a program where the apparent numbers are always displayed as depicted in FIG. 1 is the preferred configuration. After the lapse of a predetermined amount of time, a sucking sound is generated, followed by a popping sound as an apparent ball escapes its cylinder and enters the apparent space between apparent funnels 44, 46. Preferably, the program causes the apparent ball on the left side of the video screen to enter said space first. The other apparent balls enter into their respective apparent spaces at predetermined intervals thereafter, just as in the mechanical version of the game. Simultaneously, the selected numbers in display row 38 are displayed so that the player sees the software-selected numbers in two locations, i.e., on the apparent balls trapped between funnels 44, 46, and on said row 38. Again, a match results in dispensing of money or coupons into coin box 30 whereas a mismatch results in the end of the game without a monetary reward. Of course, as in any gaming device, small awards are made at frequent intervals to encourage continued play but large awards are rare.

As an extra feature, the software could be written such that the tumbling routine brings the balls bearing the numbers about to be selected towards the top of their respective apparent cylinders before being carried into their respective ball trapping members at the end of the game.

If a player decides to quit playing before exhausting the credit balance displayed at 54, the "Cash Out" button in row 37 is pressed and all money on credit is refunded into tray 30.

Note how the apparent balls trapped between apparent funnels 44 and 46 are skewed to further provide the illusion that mechanical balls have been trapped in a constriction. Of course, the player realizes the screen is providing a video display of the well-known mechanical version of the machine, but software details such as skewing the selected balls as depicted adds another touch of realism to the device.

A player who likes the number selected by the software in response to activation of the "Pick #" button, or who wants to play again using the previous player-selected numbers, may press the "Replay" button in row 36 and thus need not re-enter the numbers again. A person who makes a mistake when entering a personally-selected number presses the "Clear" button in row 36 before pressing the "Start" button so that the error can be corrected. As each button in row 28 is pressed, the selected number appears in row 40, in a left-to-right sequence, so that the player may see the display of selected numbers. If a player thinks the correct buttons in row 28 were pressed, but then sees a "wrong" number displayed in row 40, the "Clear" button is pressed to enable re-entering of the desired number. The "Clear" button is deactivated when the "Start" button is pressed.

Those players familiar with the mechanical versions of the machine, which includes almost all members of the public, are attracted to the unique simulation provided and since the mechanical version of the machine has been seen by few people, they are especially attracted to the video version thereof because its apparent operation is understandable and trustworthy. The novel apparatus thus has considerably more appeal than an electronic machine that simply generates random numbers and makes a payout upon matching numbers selected by players.

FIGS. 3 through 9 disclose the steps required to make the inventive device perform in the manner herein disclosed.

Figure 3:
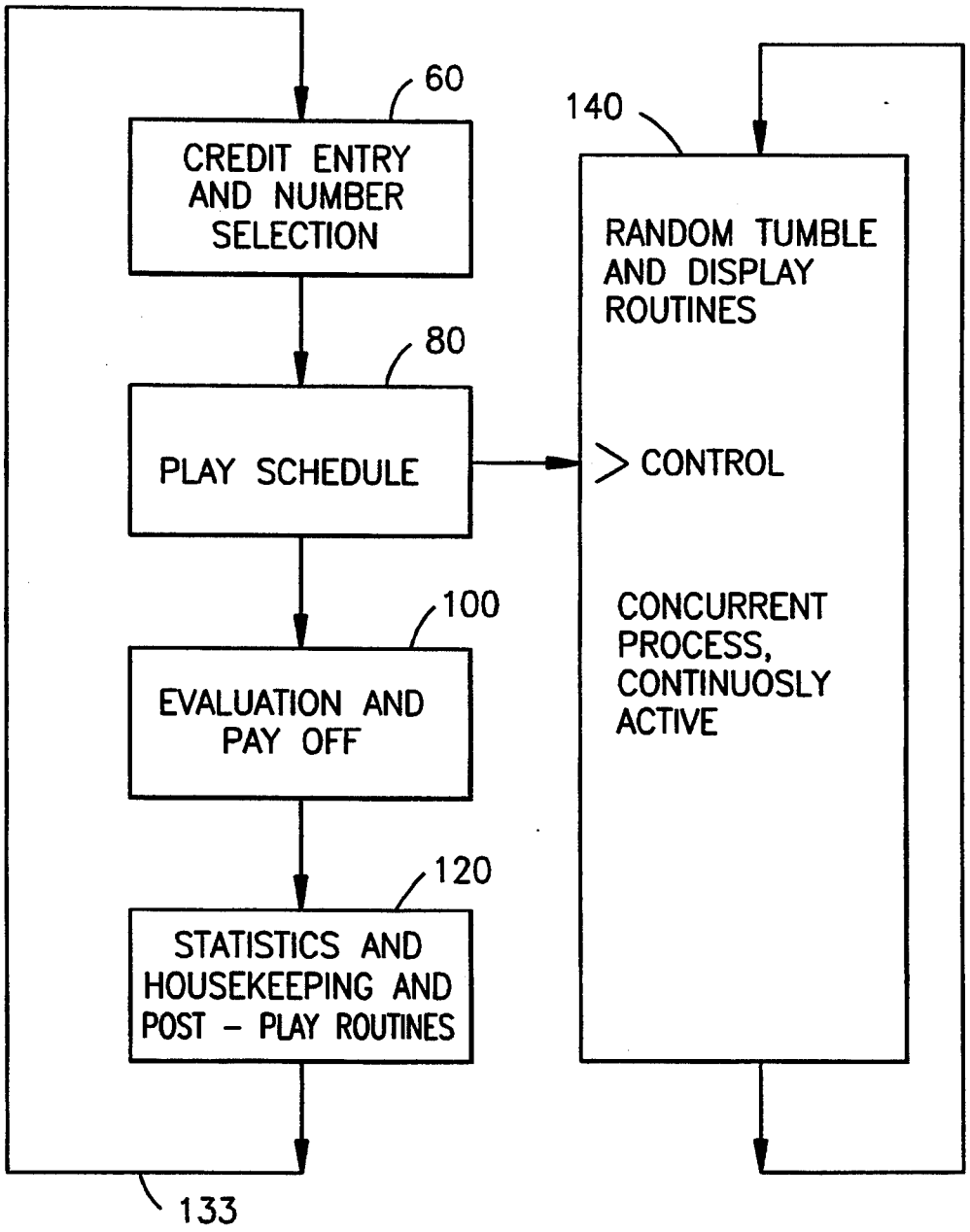
FIG. 3 is a high level flow chart providing an overview of the novel method for generating the audio and video simulations of this invention.

More particularly, FIG. 3 provides an overview of the novel method. The step of recording the amount of money inserted into the machine by the player and the player's number selection is performed at function block 60. The program then flows to function block 80 where the play sequence is initiated and to function block 140 which performs the step of generating the random tumble of the apparent balls within their respective apparent cylinders. Evaluation and pay-off are then performed as denoted by function block 100, and the program concludes by flowing to function block 120 where post-play operations such as statistical analysis and other housekeeping chores are performed.

Figure 4:
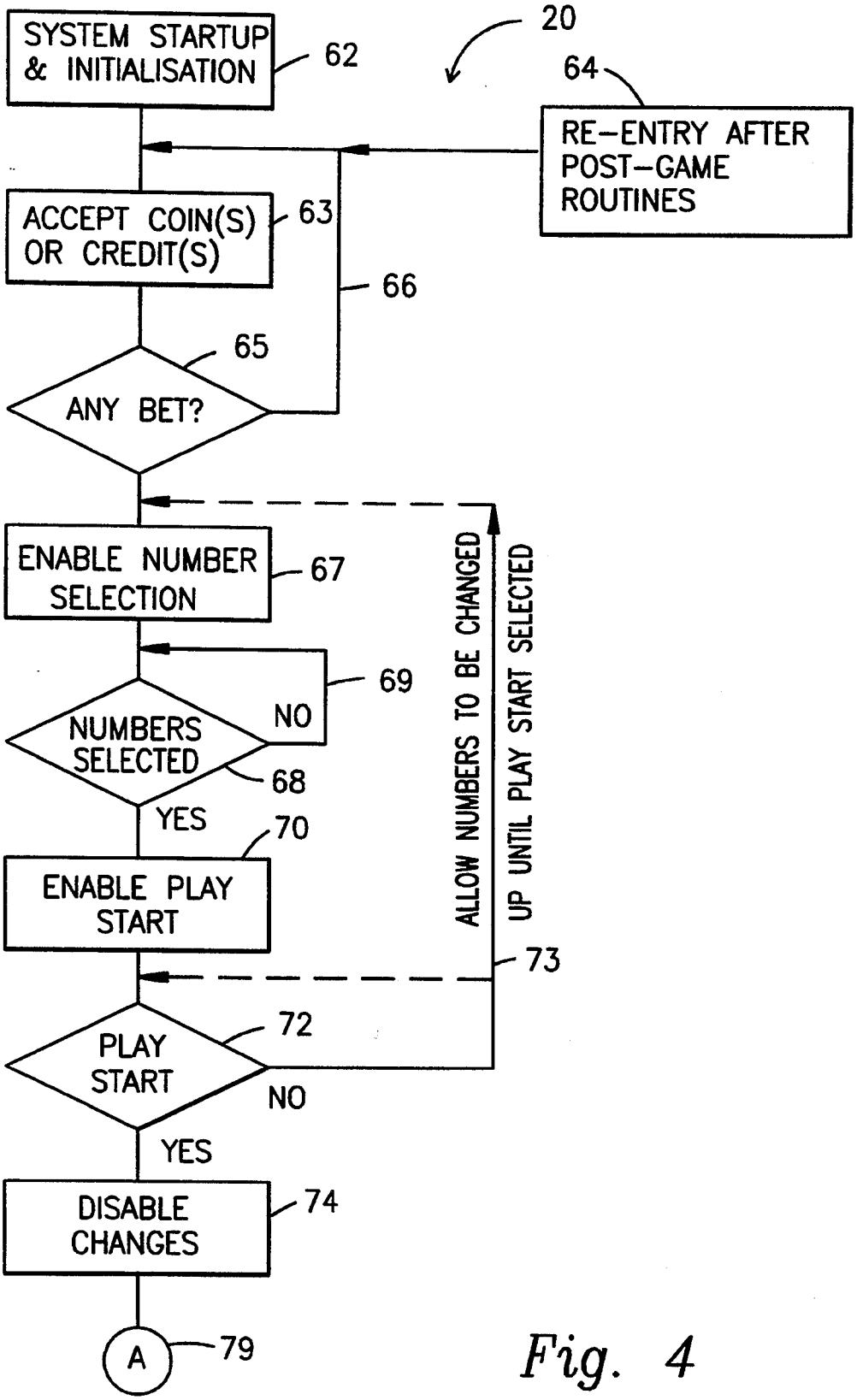
FIG. 4 is a flow chart explaining how the credit entry and number pick steps of the novel method are performed.

A more detailed look at the functions performed at function block 60 is provided in FIG. 4. System start-up and initialization functions are performed at function block 62. The program then flows to function block 63 which performs the function of activating the means for accepting coins, bills, or credit cards. As indicated in FIG. 3, at the completion of the housekeeping chores at function block 120, the program returns to function block 60; as shown in FIG. 4, the specific re-entry after the post game routines, represented by function block 64, is made upstream of function block 63. Decision block 65 then determines the total amount of money deposited by the player in cash or by credit card. If no money has been deposited, indicating that no bet has been made, the program returns to the entry of function block 63 along No path 66. If a bet has been made, program flow continues to function block 67 which enables the keys in rows 34 and 36 so that the player may select numbers or direct the machine to select numbers. Decision block 68 determines whether or not numbers have been selected, and if not, the program flows along No path 69 to the entry of decision block 68. The Start button in row 36 is then activated at function block 70, and decision block 72 then determines whether or not said button has been activated. If the play start button has not been pressed, the program flow follows No path to the entry side of function block 67 so that the player may change the selected numbers. If decision block 72 determines that the start play button has been pressed, the program flow follows a Yes path to Disable Changes function block 74 which performs the function expressed by its name.

Figure 5:
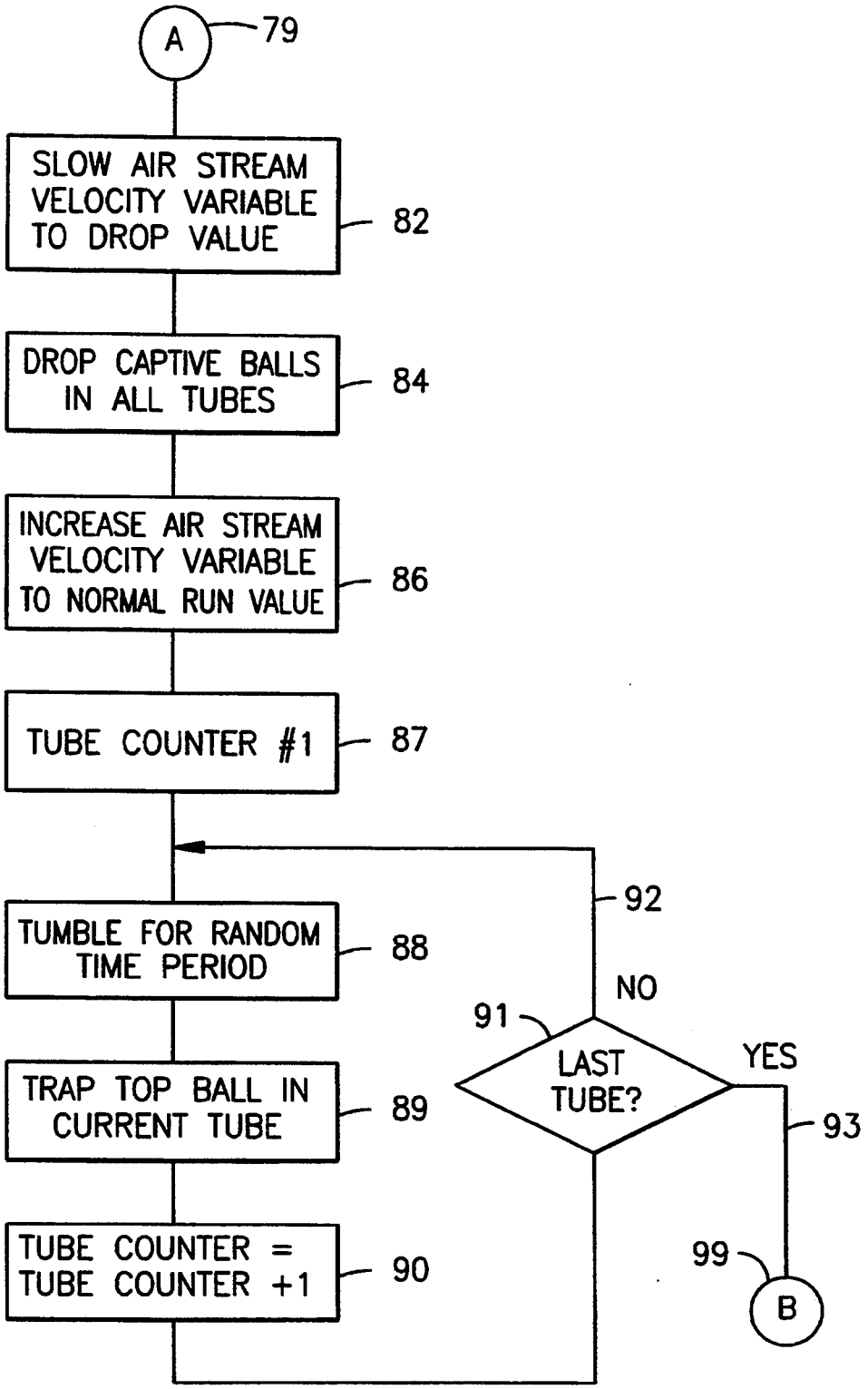
FIG. 5 is a flow chart depicting the novel play sequence.
Figure 6:
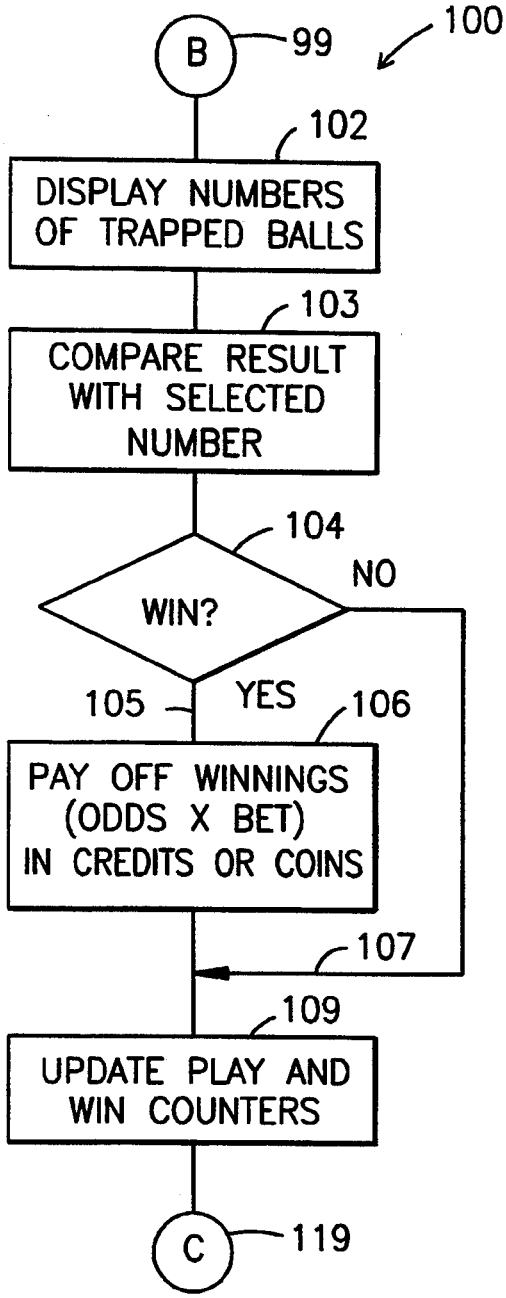
FIG. 6 is a flow chart depicting the evaluation and payoff steps.
Figure 7:
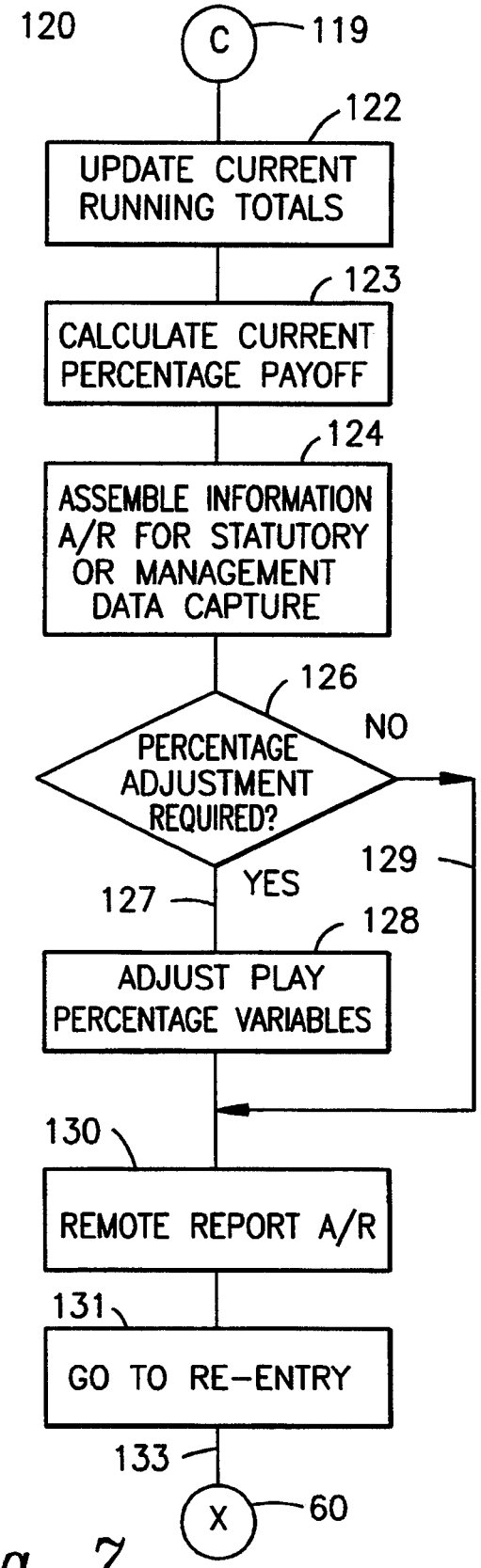
FIG. 7 is a flow chart depicting statistical and housekeeping steps.

When the ability of the player to change the selected numbers has been disabled, the program flows to the entry side 79 of function block 82 which performs the first function in Play Sequence routine 80 as depicted in FIG. 5. More particularly, the apparent velocity of the apparent upflowing airstream is slowed to a predetermined low velocity that enables the apparent balls trapped in their respective ball-trapping means at the conclusion of the previous game to apparently fall back into their respective apparent cylinders; this apparent slowing of velocity is accompanied by the sound effect of an air compressor shutting down; all of these functions are performed at function block 82. The balls are then dropped into their respective tubes when the program flows to function block 84, and function block 86 performs the function of increasing the apparent velocity of the air stream until it reaches its normal run value, accompanied by the sound of an air compressor starting up. At function block 87, the program then sets a tube counter value equal to one. It next flows to function block 88 where the apparent balls are made to tumble for a random time period. At the expiration of a random time, the program flows to function block 89 where the step of trapping a ball between the apparent funnels is performed, accompanied by the sound of a ball escaping a cylinder and becoming trapped between the vertically flipped funnels. The program then flows to function block 90 where it increments the tube counter value by 1. Decision block 91 then determines whether or not all four apparent balls have been captured. If not, the program flows along No path 92 to the entry of function block 88; if all balls have been captured, the program flows along Yes path 93 to the entry 99 of the evaluation and payoff routine 100 (FIG. 6).

The first step of the evaluation and payoff routine is to display the numbers randomly selected by the random number generator, i.e., the numbers appearing on the apparent balls trapped between the apparent funnels; that function is performed at function block 102. The program then flows to function block 103 where the numbers displayed at step 102 are compared with the numbers selected by the player. Decision block 104 determines if a match has occurred. If a match has occurred, the program flows along Yes path 105 to function block 106 that performs the function of paying the winnings to the player. The program then flows to function block 109 where the play and win counters are updated. If no match is found, the program flows along No path 107 to the entry of function block 109, bypassing block 106. Flow then goes to the entry 119 of subroutine 120 where statistical analysis and other housekeeping chores are performed.

The first three major functions of program 120 are to update the current running totals, to calculate the current percentage payout, and to assemble information for statutorily-mandated or management-desired data, said functions being performed at function blocks 122, 123, and 124, respectively. After those three functions have been performed, the program flows to decision block 126 where a determination is made as to whether or not a percentage adjustment is required, based upon management-supplied guidelines. If the answer is affirmative, the program flows along Yes path 127 to Adjust Play Percentage Variables function block 128 which performs the function its name expresses. For example, if the machine is not paying off frequently enough, the frequency of payoff is adjusted upwardly at function block 128. If no percentage adjustment is required, the program flows along No path 129, bypassing function block 128 as depicted. A remote report is then prepared at function block 130, and the program then flows to function block 131 which directs the program flow along path 133 to the beginning of program 60 (see FIG. 3).

As mentioned earlier, play sequence program 60 includes the routine that simulates the tumbling of the apparent balls. There are two ways to provide the random tumbling effect; such alternate ways are depicted in FIGS. 8 and 9.

Figure 8:
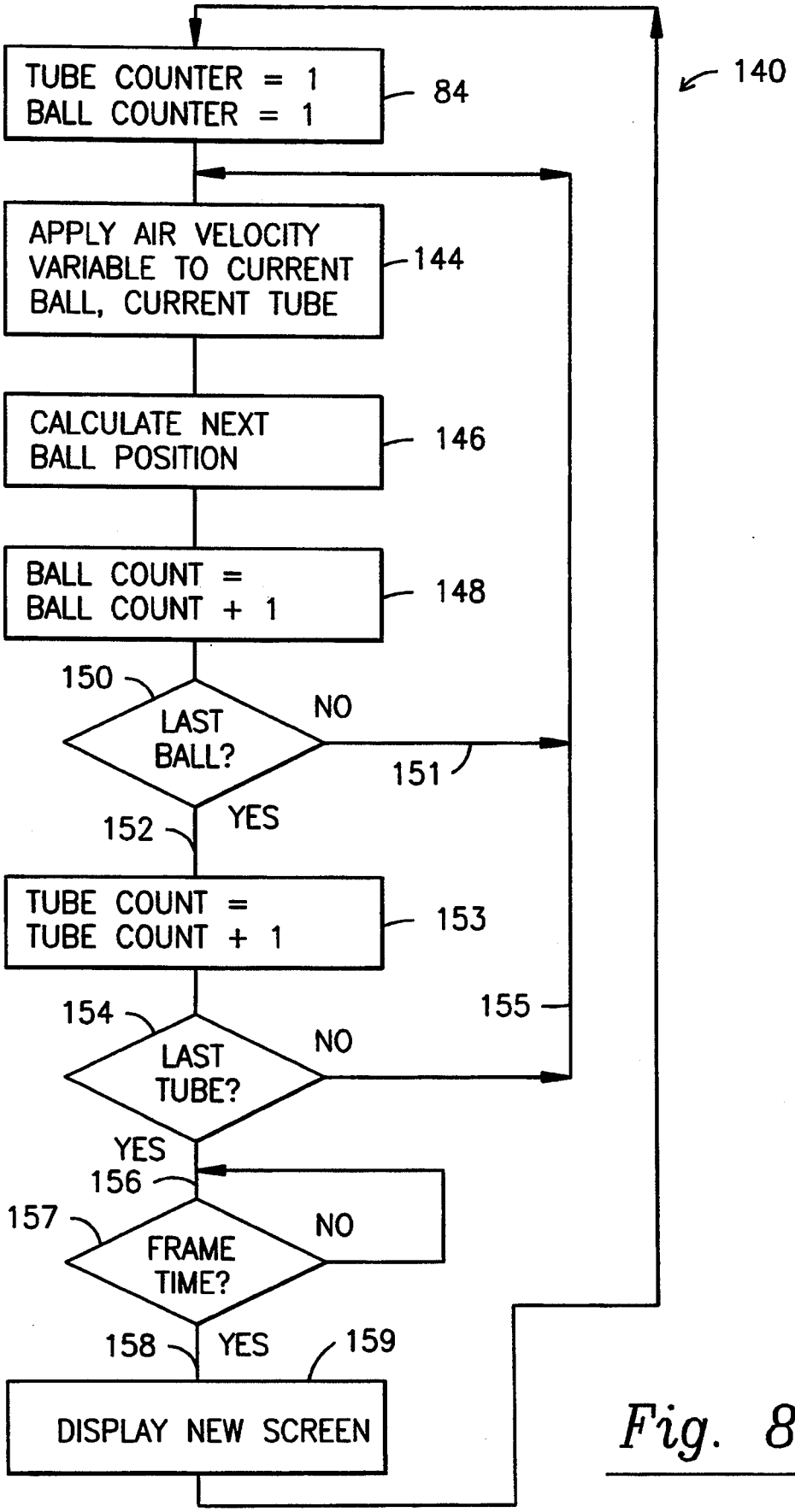
FIG. 8 is a flow chart explaining the steps of a first method of generating a random tumble of the computer-generated balls.

The preferred technique is disclosed in FIG. 8; it relies upon an algorithm to calculate new ball positions and will thus be referred to as the mathematical method. More specifically, this method applies motion equations to the ball images and continually recalculates new ball positions so that they appear to be tumbling in a manner caused by an upwardly flowing airstream acting upon them. Random tumble routine 140 begins at function block 142 where a tube counter is set equal to one and a ball counter is set equal to one. At function block 144, the motion equations are employed by applying an air velocity variable to the current ball and the current tube; the program then flows to function block 146 where the next ball position is calculated for the current ball and the current tube, based upon said air velocity variable. Function block 148 then increments by one the ball count, and decision block 150 then determines whether or not the current ball is the last ball. If it is not, the program flows along No path to the entry of decision block 144; if the current ball is the last ball, the program flows along Yes path 152 to function block 153 where the tube count is incremented by one. The program flow then moves to decision block 154 where it is determined whether or not the current tube is the last tube. If it is not, the program flows along No path to the entry of function block 144; if it is the last tube, the program flows along Yes path 156 to decision block 157 where it is decided whether or not the frame time has expired. If it has not, the program returns along No path 157 to the entry of block 156 and the loop continues until it is time for a new frame. When it is time for a new frame, the program flows along Yes path to Display A New Screen function block 159 which performs the function its name expresses. The time between frames is short to harness the persistence of vision effect to create the illusion of continuous motion.

Figure 9:
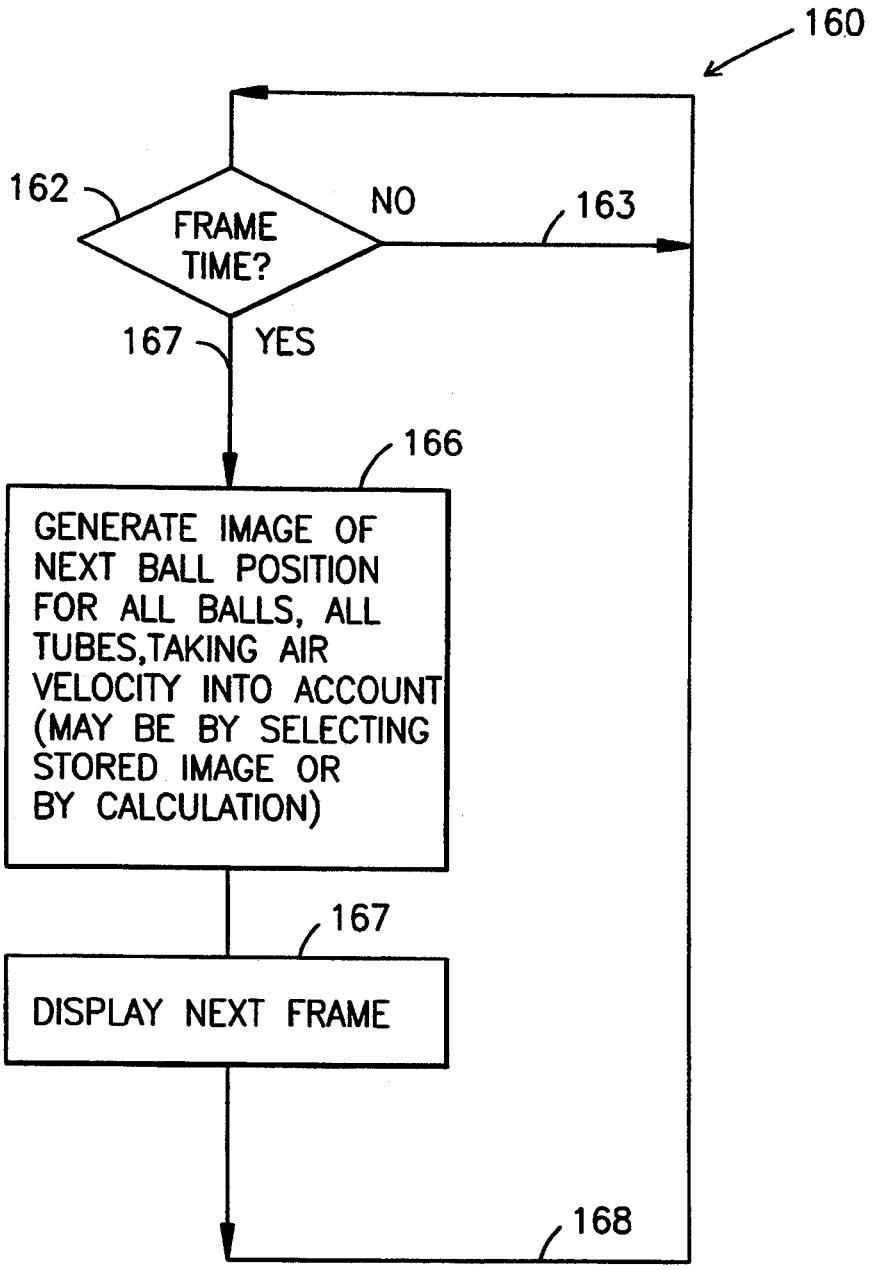
FIG. 9 is a flow chart explaining the steps of a second method of generating a random tumble.

A non-mathematical means for generating the simulated tumble of balls is disclosed in FIG. 9 and is denoted 160. Decision block 162 first determines if it is time for a new frame. If it is not, No path 163 returns the program to the input of decision block 162. If it is time for a new frame, the program flows over Yes path 165 to function block 166. A new image is then generated by either generating the next position for all of the balls in all of the tubes employing motion equations as in the method of FIG. 8, or by the expedient of getting the next ball positions from memory. The program then flows to Display Next Frame function block 167 which performs that function, and the above process is repeated as indicated by program flow path 168.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without department from the scope of the invention, it is intended that all matters contained in the foregoing construction or shown in the accompanying drawings shall be interpreted as illustrative and not in a limiting sense.

It is also understood that the following claims are intended to cover all of the generic and specific features of the invention herein described, and all statements of the scope of the invention which, as a matter of language, might be said to fall therebetween.

Now that the invention has been described,

What is claimed is:

1. An electronic game apparatus, comprising:

a video screen for displaying computer-generated images;

a mechanical housing for said video screen;

means for generating a simulated plurality of transparent housings on said video screen;

means for generating a simulated plurality of numbered balls within each of said simulated housings;

means for simulating an apparently upwardly flowing airstream within each of said housings to provide an apparent means for mixing said balls and hence said numbers;

means for maintaining an apparent number on each of the numbered balls in an orientation facing a player at all times;

means for simulating a first ball-trapping means atop each simulated housing;

means for simulating a second ball-trapping means in spaced apart relation to each of said first ball-trapping means;

a random number generating means;

means for displaying a simulated ball and its associated number between each of said first and second ball-trapping means after the passage of a predetermined amount of time;

said random number generating means controlling the means for displaying the simulated balls between the first and second ball-trapping means;

mechanical means connected to said mechanical housing for enabling a player to select a random series of numbers;

means for matching numbers selected by said player with numbers generated by said random number generating means; and mechanical means for dispensing a predetermined amount of money to the player if the numbers selected by the player match the numbers generated by the random number generating means.

2. The game apparatus of claim 1, further comprising a display means for displaying the numbers selected by the player prior to the commencement of the simulated mixing of the balls.

3. The game apparatus of claim 2, further comprising a display means for displaying the numbers selected by the random number generator.

4. The game apparatus of claim 3, wherein said display means for displaying numbers selected by the random number generator is the display of the simulated balls between the first and second simulated ball-trapping means.

5. The game apparatus of claim 3, wherein said display means for displaying numbers selected by the random number generator is a display independent of the display of the simulated balls between the first and second simulated ball-trapping means.

6. The game apparatus of claim 1, further comprising a mechanical button means that enables a player to cause the random number generating means to select a random number representing the player's random number.

7. The game apparatus of claim 1, further comprising a mechanical button means that enables a player to commence the simulated mixing of the apparent balls after the player has selected a plurality of random numbers.

8. The game apparatus of claim 7, further comprising disabling means for disabling a player's ability to change the player's random numbers after said simulated mixing has commenced.

9. The game apparatus of claim 1, further comprising sound-generating means to simulate the sound of an air compressor and balls tumbling in said respective housings.

10. The game apparatus of claim 9, wherein said sound-generating means generates the sounds of an air compressor starting up, running at normal operating speed, and shutting down, said sounds being generated to correspond to appropriate computer-generated video images appearing on said video screen.

* * * * *